US007575476B2

(12) United States Patent
Tyler et al.

(10) Patent No.: US 7,575,476 B2
(45) Date of Patent: Aug. 18, 2009

(54) POWER DISTRIBUTION MODULE AND HEADER ASSEMBLY THEREFOR

(75) Inventors: Adam P. Tyler, Rochester Hills, MI (US); Douglas Scott Simpson, Mount Clemens, MI (US); Yezdi N. Soonavala, Rochester Hills, MI (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/888,469

(22) Filed: Aug. 1, 2007

(65) Prior Publication Data

US 2009/0034165 A1 Feb. 5, 2009

(51) Int. Cl.
*H01R 13/648* (2006.01)

(52) U.S. Cl. ..... 439/607; 439/101

(58) Field of Classification Search ..... 439/101, 439/607–610, 108

See application file for complete search history.

(56) References Cited

U.S. PATENT DOCUMENTS

| | | | | |
|---|---|---|---|---|
| 5,709,569 | A | 1/1998 | Buck et al. | |
| 6,206,731 | B1 | 3/2001 | Kuo | |
| 6,231,384 | B1 | 5/2001 | Kuo | |
| 6,231,385 | B1 | 5/2001 | Kuo | |
| 7,264,508 | B2 * | 9/2007 | Sakakura et al. | 439/607 |
| 7,311,566 | B2 * | 12/2007 | Dent | 439/843 |
| 7,344,413 | B2 * | 3/2008 | Nishida | 439/610 |
| 2003/0082937 | A1 | 5/2003 | Burdick | |
| 2006/0205250 | A1 | 9/2006 | Dickson | |
| 2007/0128938 | A1 | 6/2007 | Kuo | |

* cited by examiner

*Primary Examiner*—Truc T Nguyen

(57) ABSTRACT

A power distribution module includes a housing having a component chamber configured to house an electrical component therein. The housing includes at least a portion thereof defining a shield interface. A header assembly is coupled to the housing. The header assembly includes a header body including an inner body portion and an outer body portion, and the header assembly further includes a header shield positioned between the inner and outer body portions. The header shield engages the shield interface of the housing when the header assembly is coupled to the housing.

20 Claims, 10 Drawing Sheets

POWER DISTRIBUTION MODULE AND HEADER ASSEMBLY THEREFOR

BACKGROUND OF THE INVENTION

This invention relates generally to power distribution modules, and more particularly, to methods and apparatus for connecting header assemblies to power distribution modules.

Due to the ever-increasing electrical content present within automotive vehicles, the power distribution system within vehicles has become more complex. Accordingly, power distribution boxes have been commonly employed within many vehicles. The power distribution boxes are typically connected to the vehicle's battery by a main power cable. Tap cables are also connected to the power distribution boxes and run to the various electrical components within the vehicle that require powering. At least some known power distribution boxes include a header assembly that is configured for mating with a header connector that is pluggable into the header assembly.

The header assemblies typically include a header housing that extends from the power distribution box and that defines a mating interface for the header connector. Pin terminals that are mounted within the power distribution box and extend at least partially into the header housing are oriented for mating engagement with the header connector to distribute the power to the header connector. The header housings are typically mounted to the power distribution box by fastening hardware, such as screws, washers and threaded inserts. Such fastening hardware increases the cost, size and design and assembly complexity of the power distribution module.

Additionally, conventional power distribution systems are adapted for use with low voltage distribution systems, which distribute power from a conventional 12 volt battery. Such systems are not equipped to operate with high voltage systems that are employed in some vehicles, such as electrical vehicles.

As such, a need remains for a power distribution system that may be assembled in a cost effective and reliable manner. Additionally, a need remains for a power distribution system that is capable of distributing high voltage power through the system.

BRIEF DESCRIPTION OF THE INVENTION

In one embodiment, a power distribution module is provided including a housing having a component chamber configured to house an electrical component therein. At least a portion of the housing defines a shield interface. A header assembly is coupled to the housing. The header assembly includes a header body including an inner body portion and an outer body portion, and the header assembly further includes a header shield positioned between the inner and outer body portions. The header shield engages the shield interface of the housing when the header assembly is coupled to the housing.

Optionally, a channel may be formed between the inner and outer body portions, wherein the header shield is received within the channel. The header shield may include flexible mounting tabs extending therefrom, wherein the mounting tabs engage the shield interface of the housing to create an electrical connection therebetween. Optionally, the header shield may include mating tabs extending therefrom, wherein the mating tabs are positioned within the header body for engagement with a mating connector to electrically common the header shield with the mating connector.

In another embodiment, a power distribution module is provided including a housing having a component chamber configured to house an electrical component therein, wherein the housing includes an opening through a wall defining the housing. A header assembly is coupled to the housing such that at least a portion of the header assembly extends through the opening and is configured to electrically connect with the electrical component. The header assembly includes a header body and a header shield coupled to the header body. At least one of the header body, the header shield and the housing includes a latch extending therefrom, wherein the header assembly is secured to the housing by the latch.

In a further embodiment, a header assembly is provided for a power distribution module, wherein the header assembly includes a header body including an inner body portion and an outer body portion. A channel is formed between the inner and outer body portions and the inner body portion including a bore extending therethrough. A pin terminal is received within the bore of the inner body portion and is configured for engagement with a mating connector. A header shield is positioned in the channel and configured for engagement with a housing of the power distribution module and with the mating connector to electrically common the mating connector and the housing. Optionally, the header shield may include a body having a hollow interior extending along a longitudinal axis, and the header shield may include a first set of tabs extending from a first portion of the body and a second set of tabs extending from a second portion of the body. The tabs are oriented non-parallel to the longitudinal axis and the first set of tabs are configured to engage the housing of the power distribution module and the second set of tabs are configured to engage the mating connector.

DETAILED DESCRIPTION OF THE INVENTION

Figure 1:
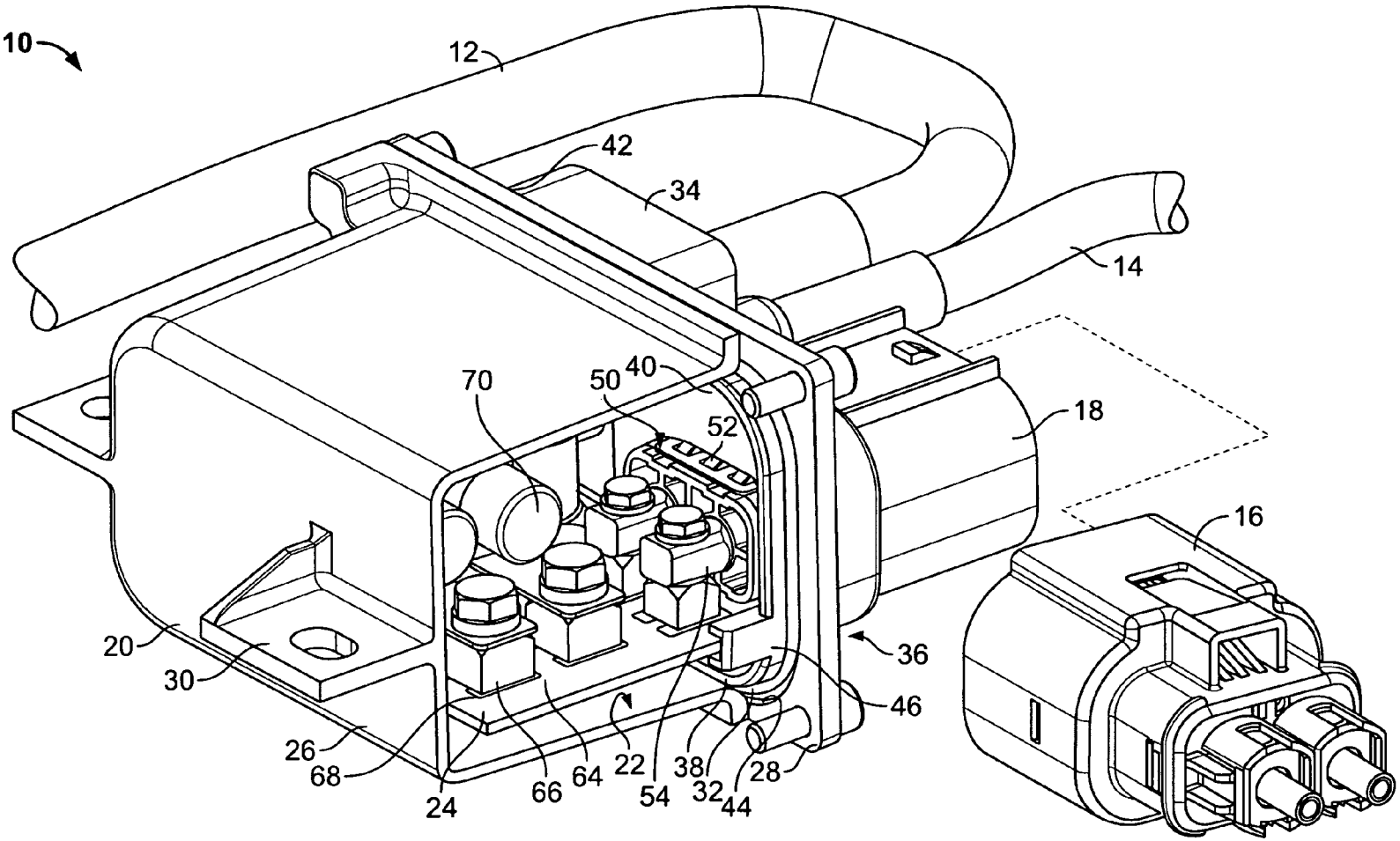
FIG. 1 is a partial cutaway view of a power distribution module formed in accordance with an exemplary embodiment illustrating a header assembly coupled to a housing.

FIG. 1 is a partial cutaway view of a power distribution module 10 formed in accordance with an exemplary embodiment. The power distribution module 10 is used within a power distribution system and distributes power from a main power conductor 12 to a tap power conductor 14 and to a mating connector 16, represented in FIG. 1 by a header connector, that is matable with a header assembly 18. Optionally, more than one tap power conductor and/or header assembly 18 may be provided. In an exemplary embodiment, the power distribution module 10 represents a power distribution box, however, the power distribution module may be another type of module for distributing power, such as, but not limited to, a power junction box, a relay module, and the like.

In an exemplary embodiment, the power distribution module 10 is adapted for an automotive application and is mounted, for example, in an engine compartment of the vehicle. As such, the power distribution module 10 is subjected to a harsh environment of high temperatures and vibrations. The power distribution module 10 may be designed to be rugged and sturdy to withstand the harsh environment. The power distribution module 10 may also be subjected to a moist or wet environment, and may be designed to be sealed from moisture from the surrounding environment.

The power distribution module 10 includes a housing 20 defining a component chamber 22 that receives at least one electrical component 24 therein. In an exemplary embodiment, the housing 20 includes a housing body 26 that defines the component chamber 22 and a housing faceplate 28 that covers the component chamber 22. The housing body 26 may be substantially box-shaped and may include tabs 30 for mounting to a frame or other support structure. However, the shape of the housing body 26 may depend on the size and shape of the electrical component 24 received therein and/or the size of the location in which the housing 20 is mounted. Additionally, other types of fastening elements may be used to secure the housing 20 to the support structure. In an exemplary embodiment, the housing body 26 and the faceplate 28 are fabricated from a conductive material, such as a metal material.

The faceplate 28 is securely coupled to the housing body 26, such as by using fasteners. Optionally, and as illustrated in FIG. 1, a seal 32 is provided between the faceplate 28 and the housing body 26. The seal 32 may be a rubber gasket, or another type of seal such as sealant applied to one of the faceplate 28 or the housing body 26. The faceplate 28 includes a conductor mounting portion 34, to which the main power conductor 12 and/or the tap power conductor 14 are mounted. The faceplate 28 also includes a header assembly mounting portion 36, to which the header assembly 18 is mounted. In an alternative embodiment, the conductor mounting portion 34 and/or the header assembly mounting portion 36 may be provided on the housing body 26 rather than the faceplate 28.

In the illustrated embodiment, the faceplate 28 is generally planar and includes a lip 38 extending from a first side 40 of the faceplate 28. The power conductors 12, 14 and the header assembly 18 generally extend from a second side 42 of the faceplate 28. The lip 38 rests within the component chamber 22 and positions the faceplate 28 with respect to the housing body 26. The faceplate 28 includes a groove 44 surrounding the lip 38 and positioned radially outward from the lip 38. The seal 32 is received within the groove 44. Optionally, the faceplate 28 may include a component support 46 extending from the first side 40 of the faceplate 28. The electrical component 24 is supported by the component support 46 within the component chamber 22. The electrical component 24 may be coupled to the component support 46 and the sub-assembly may be loaded into the component chamber 22 as the faceplate 28 is mounted to the housing body 26.

The main power conductor 12 is coupled to the faceplate 28 at the conductor mounting portion 34. In an exemplary embodiment, the main power conductor 12 represents a shielded cable having a pair of individual wires (not shown) that extend through the faceplate 28 and that are terminated to the electrical component 24. Optionally, the main power conductor 12 may be configured as a high voltage cable supplying high voltage power to the power distribution module 10. High voltage may be considered as any voltage high enough to cause dangerous, life-threatening, amounts of current through a human being. For example, high voltage may be over approximately 50 volts. In one embodiment, the main power conductor 12 is configured to supply approximately 300 volts. In the automotive context, high voltage is compared to low voltage, which is approximately 12 volts, which is the amount of volts of a typical vehicle battery. When dealing with high voltage applications, particular attention may be directed to shielding the power conductor. Additionally, attention may be directed to sealing the component chamber 22 and the wires. The main power conductor 12 is coupled at an opposite end to a power source, such as a battery. One of the wires carries a positive charge from the power source to the electrical component 24 and the other wire carries a negative charge from the power source to the electrical component 24. Other types of cables/conductors/wires may be used as part of the power distribution system. Optionally, the tap power conductor 14 may be similarly coupled to the faceplate 28 and coupled at an opposite end to a distribution element or component to which the power distribution system distributes power. For example, in the embodiment of an automotive vehicle, the distribution element may be a motor, an ignition, a starter, a radio, or another element needing power to operate, or the distribution element may be another power distribution module. When the power distribution module 10 is used in non-automotive applications, the distribution element may be a different type of element that requires power to operate.

The header assembly 18 is coupled to the faceplate 28 at the header assembly mounting portion 36. In an exemplary embodiment, the faceplate 28 includes an opening 50 therethrough and at least a portion of the header assembly 18 extends through the opening 50. The header assembly 18 is generally secured to the faceplate 28 by at least one latch 52. In an exemplary embodiment, the header assembly 50 includes the latch 52. In an alternative embodiment, the faceplate 28 includes the latch 52. The header assembly 18 includes pin terminals 54 that extend from the header assembly 18 into the component chamber 22. The pin terminals 54 are electrically connected to the electrical component, and power is distributed to the header connector 16 from the electrical component 24 via the pin terminals 54.

The electrical component 24 is received within the component chamber 22 and is positioned to electrically connect to the main and tap power conductors 12, 14 and/or the header assembly 18. In an exemplary embodiment, the electrical component represents a printed circuit board. The electrical component 24 includes at least one interface 64 for mating with the power conductors 12, 14 and the header assembly 18. In an exemplary embodiment, bushings 66 are secured to the interface 64 and are electrically connected to pads 68 on the electrical component 24. The wires of the conductors 12, 14 are connected to the bushings 66, and the pin terminals 54 are connected to different ones of the bushings 66, such as by a threaded fastener. Optionally, fuses 70 may be provided and electrically connected to the bushings 66 and/or the pads 68. Predetermined ones of the pads 68 are interconnected by traces such that the power may be distributed through the power distribution module 10 from the main power conductor 12 to the tap power conductor 14 and the header assembly 18 Alternatively, rather than the pads and traces, the power distribution module 10 may distribute the power from the main power conductor 12 by wired connections, buss bars, and the like.

Figure 2:
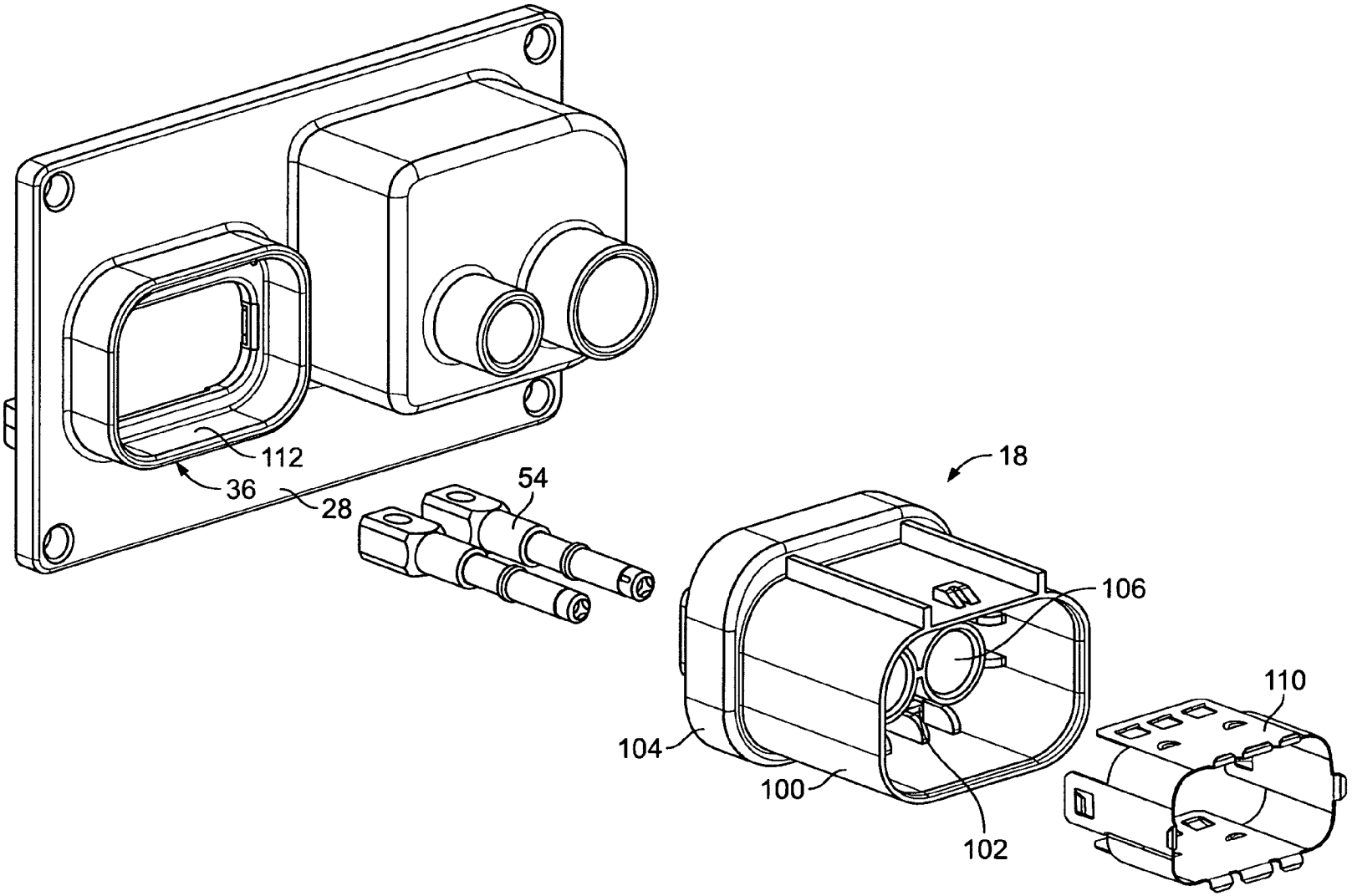
FIG. 2 is an exploded view of the header assembly and a portion of the housing shown in FIG. 1.

FIG. 2 is an exploded view of the header assembly 18 and the faceplate 28 portion of the housing 20 (shown in FIG. 1). The header assembly 18 includes a header body 100 including an inner body portion 102 and an outer body portion 104. The header body 100 is sized and shaped for mating connection with a mating connector 16 (shown in FIG. 1) that is pluggable into the header body 100. The inner body portion 102 has a pair of bores 106 that extend therethrough.

The header assembly 18 also includes a pair of the pin terminals 54 received within the bores 106 of the inner body portion 102. The pin terminals 54 are configured to engage corresponding terminals (not shown) of the mating connector 16 to provide electrical connection between the header assembly 18 and the mating connector 16.

The header assembly 18 further includes a header shield 110 that is loaded into the header body 100. The header shield 110 provides shielding for the pin terminals 54. The header shield 110 is also configured to engage the faceplate 28, such that the header shield 110 is electrically commoned with the housing 20. Additionally, the header shield 110 is configured to engage a corresponding shield (not shown) of the mating connector 16 to electrically common the header assembly 18 and the mating connector 16. As such, the header shield 110 electrically commons the housing 20 and the mating connector 16.

The header assembly 18 is mounted to the header assembly mounting portion 36. In an exemplary embodiment, the header body 100 is mounted to a lip 112 that extends from the faceplate 28. Optionally, as described in further detail below, the header assembly 18 is snappably coupled to the faceplate 28, such that the header assembly 18 may be loaded onto the faceplate 28 and retained thereto by a simple fastening mechanism, such as a latch. Optionally, in addition to the fastening mechanism, or as an alternative to the fastening mechanism, an adhesive may be used to secure the header assembly 18 to the faceplate 28. In an alternative embodiment, rather than the simple mounting/fastening means described above, a more complex mounting/fastening system may be utilized, such as threaded fasteners, clamp mechanisms, and the like. However, these more complex mounting/fastening systems tend to increase the complexity of manufacturing, assembling and/or mounting the header assembly 18. Additionally, these more complex mounting/fastening systems tend to increase the overall size of the header assembly 18, and thus the overall size of the power distribution module 10 (shown in FIG. 1).

Figure 3:
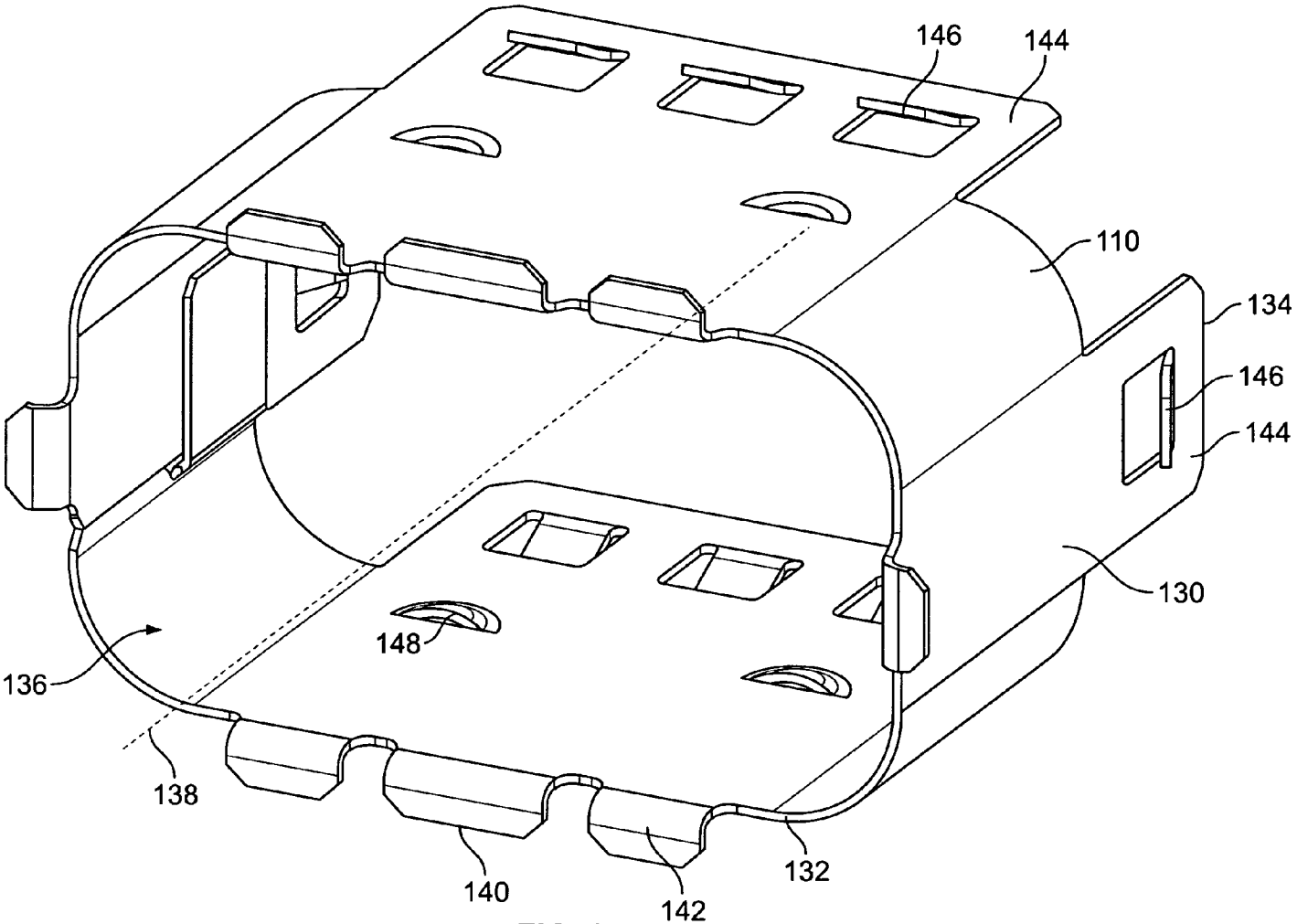
FIG. 3 is a perspective view of a header shield of the header assembly shown in FIG. 2.

FIG. 3 is a perspective view of the header shield 110. The header shield 110 includes a shield body 130 that extends between a mating end 132 and a mounting end 134. The shield body 130 completely surrounds an opening 136 that has a central axis 138 extending between the mating and mounting ends 132, 134. In an exemplary embodiment, the header shield 110 has a generally rectangular cross-section with rounded corners. In alternative embodiments, the header shield 110 may have an alternative cross-section shape, such as a circle, an oval, an ellipse, a diamond, and the like. The corners may be rounded or squared-off. In an exemplary embodiment, the header shield 110 is fabricated from a metallic material that is stamped and formed into the given shape.

In an exemplary embodiment, the mating end 132 includes mating tabs 140 that are flared radially outward from the shield body 130. An outer surface 142 of the mating tabs 140 define a mating interface for mating engagement with the corresponding shield (not shown) of the mating connector 16 (shown in FIG. 1). For example, when the mating connector 16 is plugged into the header assembly 18, the mating shield engages the mating interface portion of the mating tabs 140 to electrically common the mating shield and the header shield 110. Optionally, rather than discrete mating tabs 140, a lip may be provided at the mating end 132 that substantially circumferentially surrounds the mating end 132 and the defines a mating interface for the mating shield.

The mounting end 134 includes arms 144 that extend forward from the shield body 130. As described in further detail below, the arms 144 are configured to extend through the opening 50 in the faceplate 28 (shown in FIG. 1). The arms 144 include flexible mounting tabs 146 that are flared outward therefrom. The mounting tabs 146 are hinged about a hinge line at the forward-most portion of the mounting tabs 146. The mounting tabs 146 define a mating interface for engagement with the faceplate 28. In an alternative embodiment, rather than flexible mounting tabs, the mounting end 134 may include tabs similar to the mating tabs 140 at the mating end 132 for engagement with the faceplate 28, or another part of the housing 20, to electrically common the header shield 18 and the housing 20.

In an exemplary embodiment, the header shield 18 includes retention features 148 that extend from a central portion of the shield body 130. The retention features 148 are oriented to engage a portion of the header body 100 when the header shield 110 is loaded into the header body 100. Alternatively, the header shield 110 may include openings that receive a portion of the header body 100 to retain the header shield within the header body 100.

Figure 4:
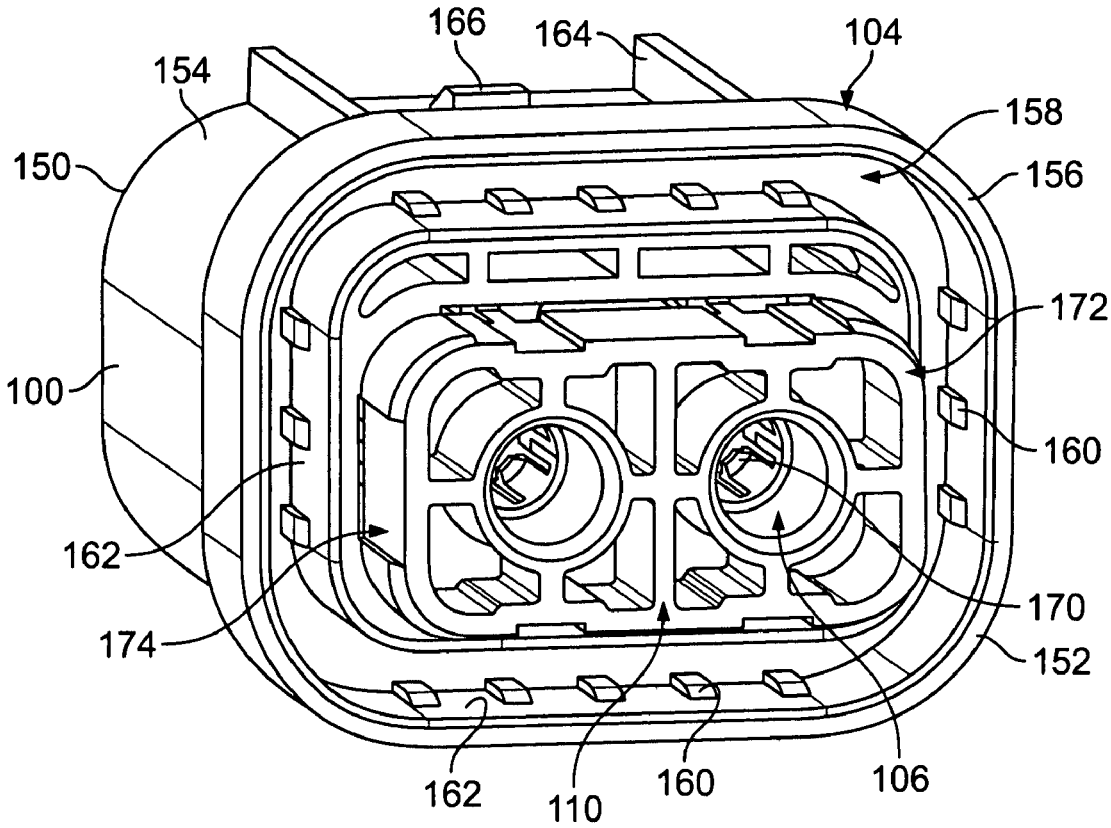
FIG. 4 is a perspective view of a header body of the header assembly shown in FIG. 2.

FIG. 4 is a perspective view of the header body 100 of the header assembly 18 (shown in FIG. 2). The header body 100 includes the inner body portion 102 and the outer body portion 104. In the illustrated embodiment, the inner and outer body portions 102, 104 are integrally formed with one another. However, the portions 102, 104 may be separately provided and coupled to one another in an alternative embodiment. The header body 100 extends between a mating end 150 and a mounting end 152. The mating end 150 is configured to receive the mating connector 16 (shown in FIG. 1) therein. The mounting end 152 is configure to be mounted to the faceplate 28 (shown in FIG. 1).

The outer body portion 104 includes an outer surface 154 that defines an outer surface of the header assembly 18. A rim 156 is provided at the mounting end 152 of the outer body portion 104. A trough or well 158 is defined radially inward of the rim 156. In an exemplary embodiment, the trough 158 is at least partially filled with an adhesive and/or a sealant for securing and/or sealing engagement with the faceplate 28. Optionally, ribs 160 are provided along walls 162 defining the trough 158. The ribs 160 may help guide the header body 100 into proper engagement with the faceplate 28. The ribs 160 may also provide a visual indication of a filling depth for the adhesive/sealant. The ribs 160 may further provide additional surface area for interfacing with the adhesive/sealant. The ribs 160 may operate as a filler material to reduce the amount of adhesive/sealant needed within the trough 158. In an exemplary embodiment, the outer body portion 104 includes alignment ribs 164 that extend from the mating end 150 toward the rim 156. The alignment ribs 164 are used to align and/or key the mating connector 16 with the header body 100 when the mating connector 16 is coupled to the header assembly 18. A locking feature 166 is provided on the outer surface 154. In the illustrated embodiment, the locking feature 166 is a protrusion that operates as a catch for a latch (not shown) on the mating connector 16. The locking feature 166 may be another structure used to secure the mating connector 16 to the header body 100, such as a latch, a finger, an opening, a channel and the like.

The inner body portion 102 includes the bores 106. The bores 106 are generally tubular, but may be another shape, depending on the shape of the pin terminals 54. In the illustrated embodiment, latches 170 are provided at the end of the bores 106 to capture the pin terminals 54 therein. In an exemplary embodiment, the inner body portion 102 includes a forward section 172 that extends forward beyond the outer body portion 104. The forward section 172 has a reduced cross-section as compared to the outer body portion 104. The forward section 172 is shaped and sized to fit within the opening 50 (shown in FIG. 1) of the faceplate 28. As such, at least a portion of the header body 100 is configured to extend through the opening 50. Optionally, and as illustrated in FIG. 4, the forward section 172 may be non-centrally located in relation to the outer body portion 104. As such, the forward section 172 may operate as a keying feature for mating the header assembly 18 to the faceplate 28. For example, the forward section 172 may be more closely positioned to one side (e.g. the bottom side in the illustrated embodiment) of the header body 100. In an alternative embodiment, the forward section 172 may have a non-symmetrical shape such that the forward section 172 only fits within the opening 50 in one orientation. Optionally, the inner body portion 102 may include a plurality of channels 174 formed therein. The channels 174 receive the arms 144 of the header shield 110 (shown in FIG. 3).

Figure 5:
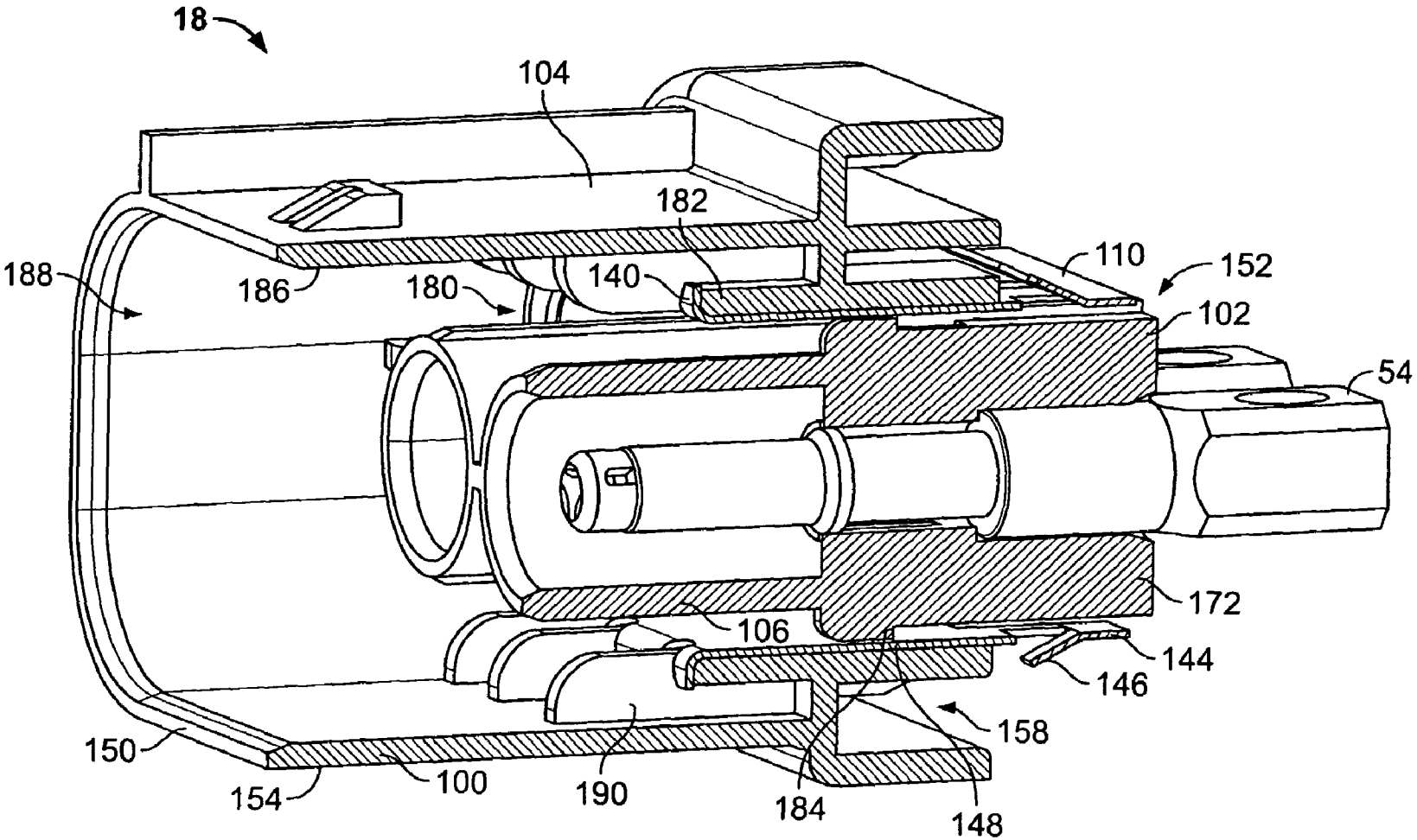
FIG. 5 is a partial cutaway view of the header assembly shown in FIG. 2.
Figure 6:
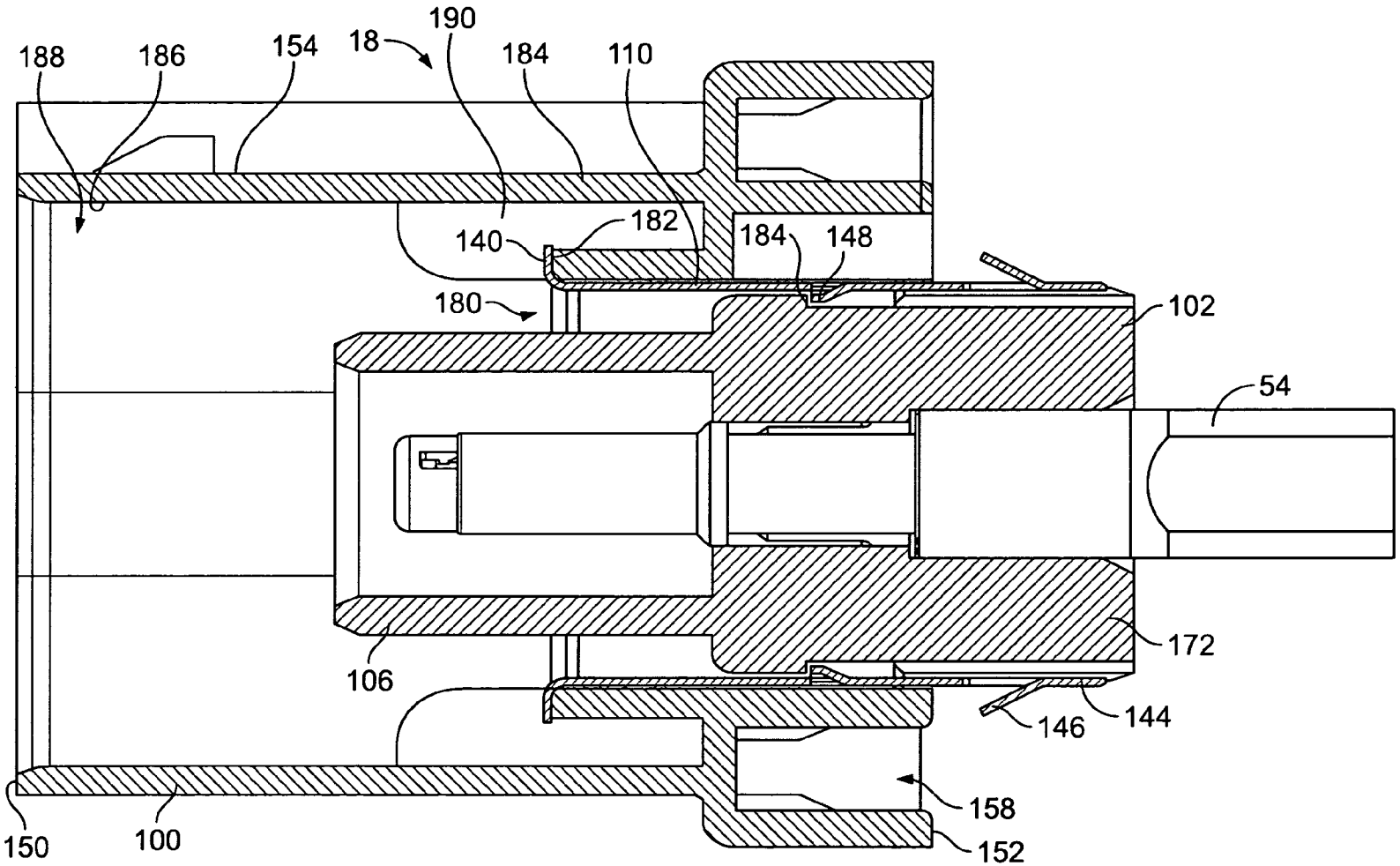
FIG. 6 is a cross-sectional view of the header assembly shown in FIG. 2.

FIG. 5 is a partial cutaway view of the header assembly 18 and FIG. 6 is a cross-sectional view of the header assembly 18. FIGS. 5 and 6 illustrate the header assembly 18 in an assembled state, wherein the pin terminals 54 are loaded into the bores 106 of the header body 100 and the header shield 110 is loaded into the header body 100. In an exemplary embodiment, the inner and outer body portions 102, 104 form a channel 180 therebetween. The header shield 110 is loaded into the channel 180 through the mating end 150 of the header body 100. The header shield 110 is loaded into the channel 180 until the mating tabs 140 of the header shield 110 engage an abutment face 182 of the outer body portion 104 to stop the loading of the header shield 110. Optionally, the inner body portion 102 may include a shoulder 184 exposed to the channel 180. When the header shield 110 is loaded into the channel 180, the retention features 148 of the header shield 110 engage the shoulder 184 to retain the header shield 110 within the channel 180 and/or to resist removal of the header shield 110 from the channel 180.

The outer body portion 104 of the header body 100 includes an inner wall 186 that surrounds a mating cavity 188. The inner body portion 102 is exposed within the mating cavity 188. At least a portion of the mating connector 16 is received within the mating cavity 188 and is plugged into the bores 106 to engage the pin terminals 54. In an exemplary embodiment, at least a portion of the mating connector 16 also surrounds the outer surface 154 of the outer body portion 104 when the mating connector 16 is mated with the header assembly 18. As further illustrated in FIGS. 5 and 6, the mating tabs 140 are exposed within the mating cavity 188. At least a portion of the mating connector 16 (e.g. a mating shield portion) interfaces with the mating tabs 140 to create an electrical connection therebetween. Optionally, the outer body portion 104 includes dividing walls 190 that extend radially inward from the inner wall 186 of the outer body portion 104. Individual ones of the mating tabs 140 are received between corresponding ones of the dividing walls 190. The dividing walls 190 thus operate to resist movement of the header shield 110 and provide rigidity to the header shield 110.

As illustrated in FIGS. 5 and 6, the forward section 172 extends beyond the outer body portion 104. The header shield 110, and more particularly, the arms 144 extend along the forward section 172. The flexible mounting tabs 146 extend outward from the inner body portion 102 and are flared outward to engage the faceplate 28 (shown in FIG. 1) when the header assembly 18 is mounted to the faceplate 28. FIGS. 5 and 6 also illustrate that the trough 158 opens to the mounting end 152 of the header body 100.

Figure 7:
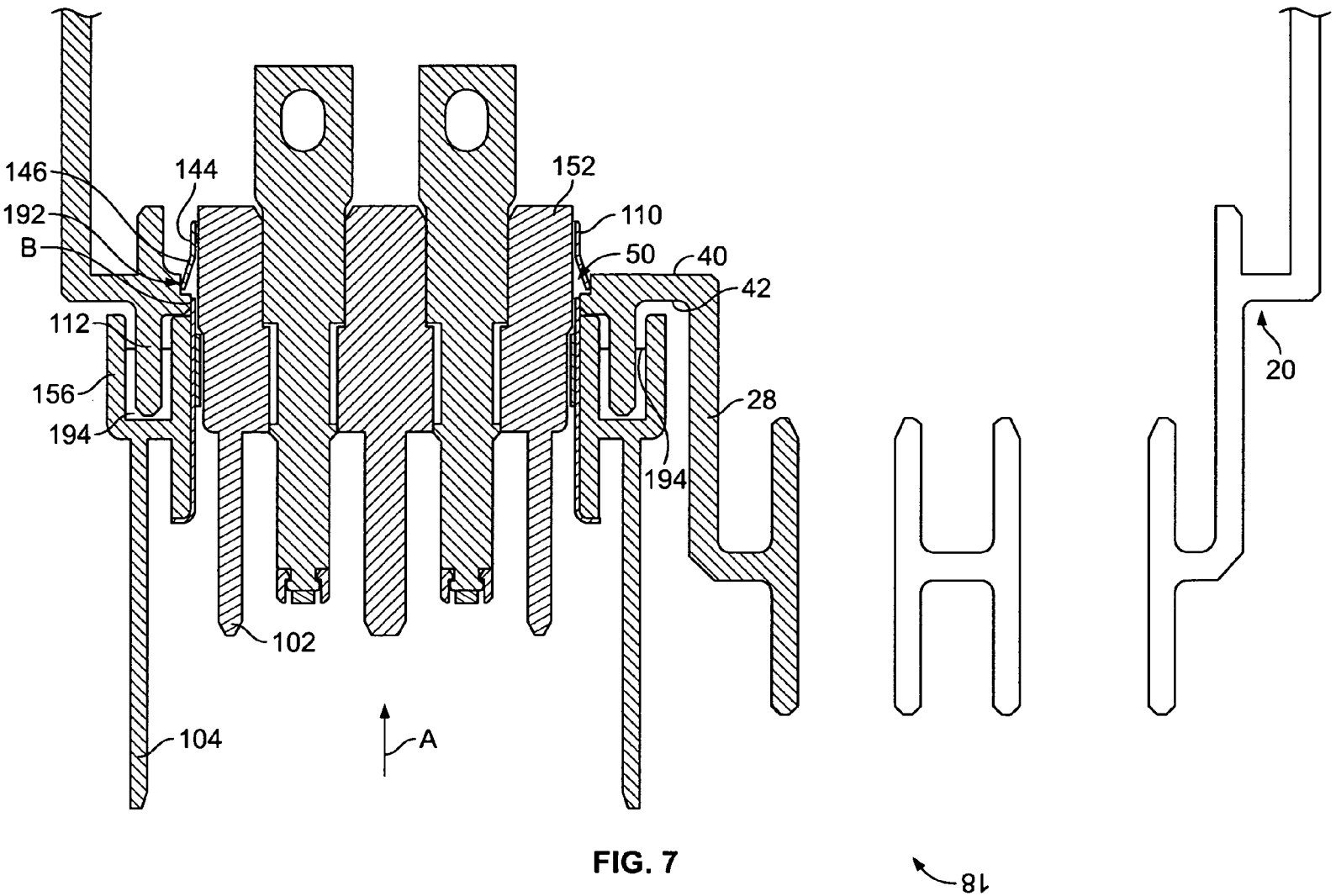
FIG. 7 is a cross-sectional view of the header assembly and a portion of the housing shown in FIG. 2.

FIG. 7 is a cross-sectional view of the header assembly 18 mounted to the faceplate 28 of the housing 20. As illustrated in FIG. 7, the forward section 172 and a portion of the header shield 110 are loaded through the opening 50 in the faceplate 28, such as in a loading direction shown by arrow A. During mating, the flexible mounting tabs 146 spring outward once the mounting tabs 146 pass through the opening 50. The mounting tabs 146 are received in pockets 192 on the second side 42 of the faceplate 28. The mounting tabs 146 engage walls defining the pockets 192 to resist removal of the header assembly 18 from the faceplate 28. The mounting tabs 146 thus operate as latches that engage the faceplate 28 to securely couple the header assembly 18 to the faceplate 28. When the mounting tabs 146 spring outward into the pockets 192, the header assembly 18 is snappably coupled to the faceplate 28. However, alternative coupling means may be provided in alternative embodiments. For example, the header body 100 may include a latch or other fastening member extending from the inner body portion 102 that engages the first side 40, or the outer body portion 104 may include a latch or other fastening member that engages the second side 42 of the faceplate 28, such as a latch on the rim 156 that engages the lip 112 on the faceplate 28. Other embodiments may use a fastening member, such as a threaded fastener, a snap-type fastener, a pin, a clamp, welding or soldering, an adhesive, and the like. For example, in the illustrated embodiment, in addition to the latch, an adhesive sealant 194 is provided in the trough 158 and the lip 112 is received in the trough 158 such that the adhesive sealant 194 engages, bonds to, and/or seals against the lip 112. Optionally, the adhesive sealant 194 may be any compound having adhesive characteristics, sealant characteristics, or both.

As further illustrated in FIG. 7, the header shield 110 is electrically connected to the faceplate 28 to electrically common the header shield 110 and the faceplate 28. For example, the mounting tabs 146 are biased against a portion of the faceplate 28 to maintain electrical connection therebetween. Additionally, a portion of the arms 144 may engage the faceplate, such as the portion that passes through the opening 50, shown by reference location B.

Figure 8:
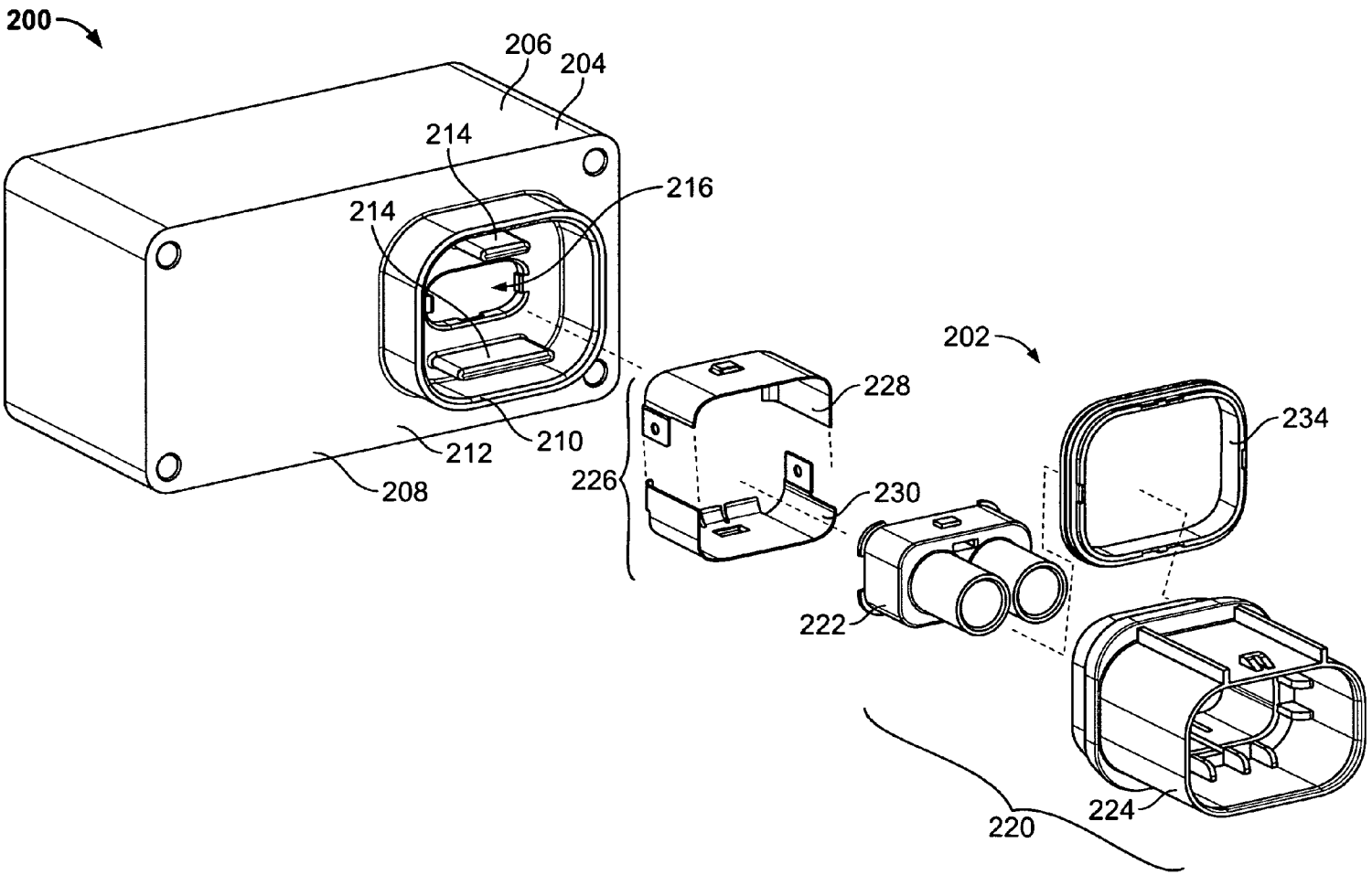
FIG. 8 is an exploded view of an alternative header assembly and housing formed in accordance with an alternative embodiment.

FIG. 8 is an exploded view of an alternative power distribution module 200 including a header assembly 202 and housing 204 formed in accordance with an alternative embodiment. The housing 204 includes a housing body 206 that houses an electrical component (not shown) and a housing faceplate 208. The faceplate 208 includes a rim 210 extending outward from a first side 212 of the faceplate 208. The rim 210 defines a mounting portion that receives the header assembly 202. In an exemplary embodiment, the faceplate 208 also includes a plurality of projections 214 that also extend from the first side 212 within the perimeter of the rim 210. Optionally, and as illustrated in FIG. 8, the projections 214 are sized and/or shaped differently to define keying features for proper orientation of the header assembly 202. The faceplate 208 also includes an opening 216 therethrough. At least a portion of the header assembly 202 is received within the opening 216 during mating of the header assembly 202 with the faceplate 208. While FIG. 8 only illustrates the mounting portion for the header assembly 202, the faceplate 208 and/or the housing body 206 may also include a mounting portion for a main power conductor and/or a tap power conductor in a similar manner as shown in FIG. 1 and describe above.

The header assembly 202 includes a header body 220 that has an inner body portion 222 and an outer body portion 224. The inner and outer body portions 222, 224 are separately provided from one another and coupled to one another during assembly. The header assembly 202 also includes a header shield 226 having a first shield portion 228 and a second shield portion 230. The first and second shield portions 228, 230 are separately provided from one another and coupled to one another during assembly. The header assembly 208 further includes pin terminals 232 (shown in FIG. 10) that are similar to the pin terminals 54 shown in FIG. 2. A header seal 234 may also be provided and positioned between the header body 220 and the faceplate 208.

Figure 9:
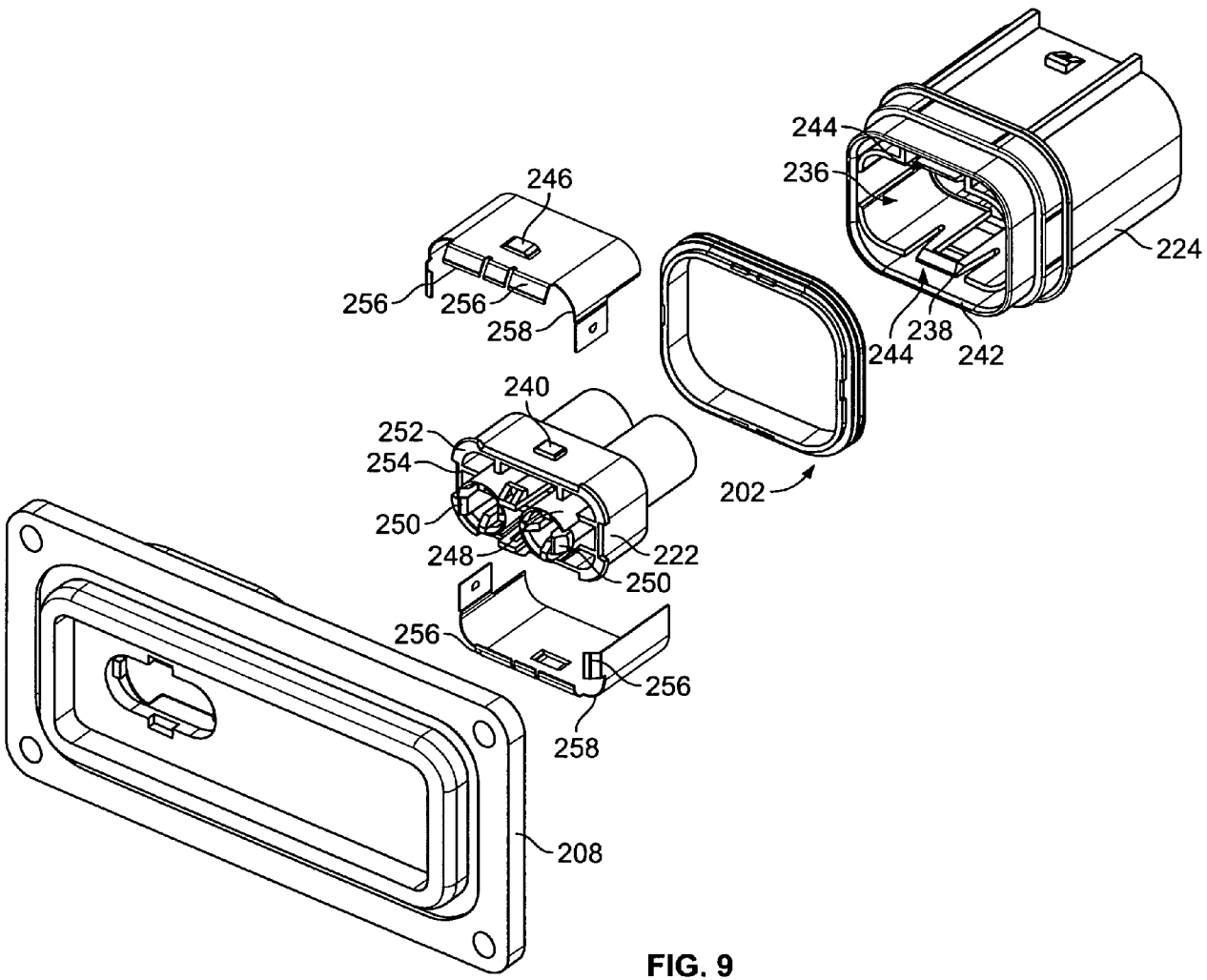
FIG. 9 is another exploded view of the header assembly and a portion of the housing shown in FIG. 8.

FIG. 9 is another exploded view of the header assembly 202 and the faceplate 208 portion of the housing 204 (shown in FIG. 8). The outer body portion 224 includes a chamber 236, into which the inner body portion 222 is received. The outer body portion 224 also includes latches 238 that engage protrusions 240 extending from the inner body portion 222. The latches 238 are spaced apart from an outer wall 242 of the outer body portion 224 such that a gap 244 is formed therebetween. The gap 244 provides a space for the latches to deflect during assembly with the inner body portion 222. In an alternative embodiment, the latches 238 may be provided on the inner body portion 222 or an alternative type of fastening means or element may be provided to securely couple the inner and outer body portions 222, 224 to one another.

Optionally, the header shield 226 includes notched portions 246 that accommodate the protrusions 240. Optionally, the notched portions 246 may be raised to accommodate the protrusions 240, or alternatively, the notched portions 246 may be completely removed to accommodate the protrusions 240. When assembled, the notched portions 246 also help to maintain proper orientation of the header shield 226 with respect to the inner body portion 222 as the notched portions 246 engage the protrusions 240 to resist movement of the header shield 226 with respect to the inner body portion 222.

The inner body portion 222 includes a forward section 248 that is sized and shaped to fit through the opening 216 in the faceplate 208 during assembly. A plurality of latches 250 are provided on the forward section 248 to securely couple the inner body portion 222 to the faceplate 208. The inner body portion 222 also includes a lip 252 surrounding an outer perimeter of the inner body portion 222 at a mounting end 254 thereof. The lip 252 defines a stop to limit the depth of insertion of the inner body portion 222 into the chamber 236. For example, the inner body portion 222 is loaded into the chamber 236 until the lip 252 engages a corresponding surface of the outer body portion 224.

The header shield 226 is adapted to surround at least a portion of the outer surface of the inner body portion 222. The header shield 226 includes a plurality of mounting tabs 256 that extend from an edge 258 of the header shield 226. The mounting tabs 256 are configured to engage the faceplate 208 when the header assembly 202 is mounted to the faceplate 28. In an exemplary embodiment, the mounting tabs 256 extend non-orthogonally from the edge 258 and are flexible such that the mounting tabs 256 may be bent when the mounting tabs 256 engage the faceplate 28. Optionally, the lip 252 of the inner body portion 222 may include a plurality of gaps that are oriented to receive the mounting tabs 256 when the header shield 226 is mounted to the inner body portion 222.

Figure 10:
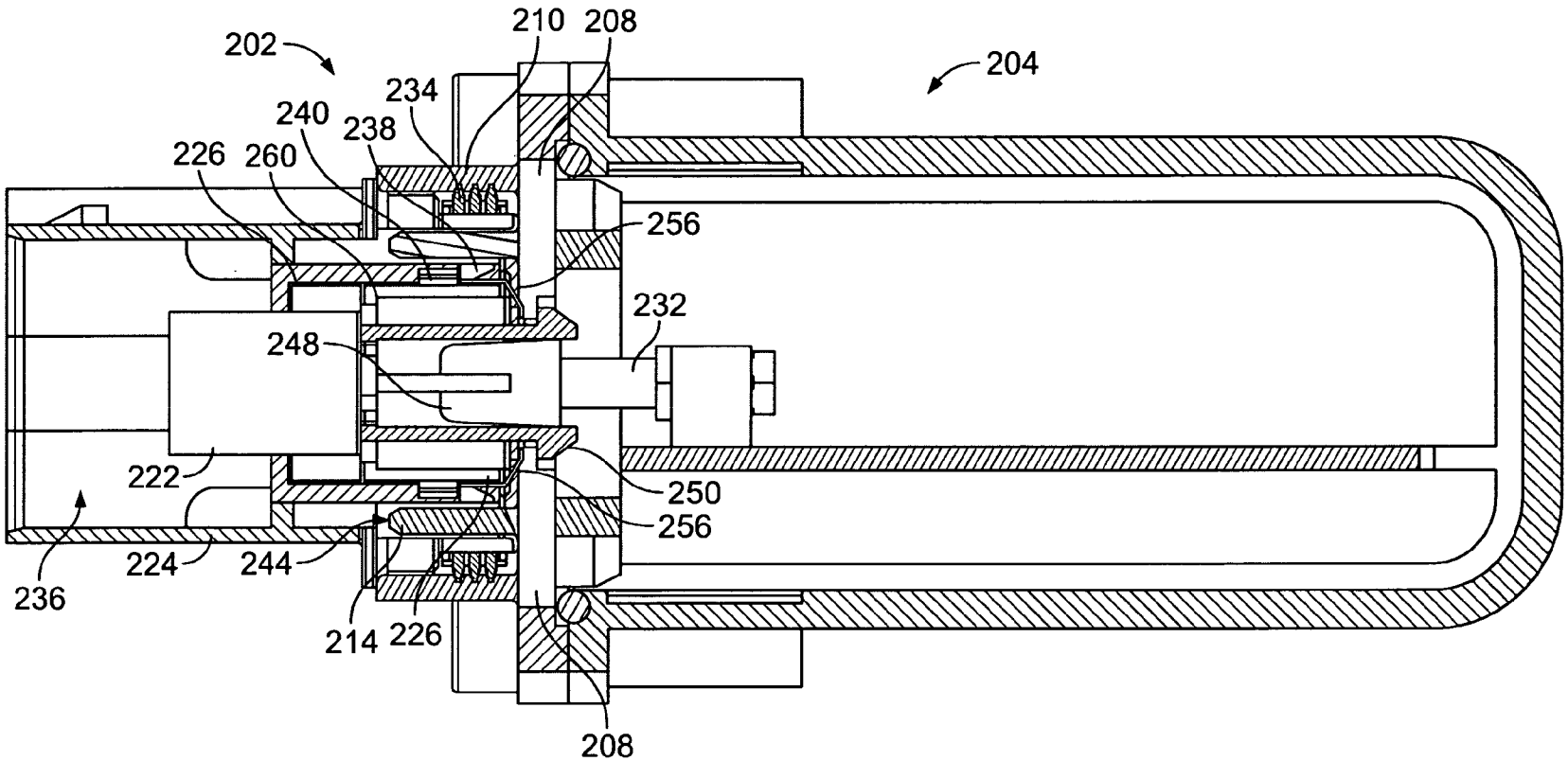
FIG. 10 is a partial cutaway view of the header assembly and housing shown in FIG. 8.

FIG. 10 is a partial cutaway view of the header assembly 202 and housing 204 in an assembled state. As illustrated in FIG. 10, the inner body portion 222 is loaded into the chamber 236 of the outer body portion 224 and is configured to interface with a mating connector (e.g. a connector similar to the header connector shown in FIG. 1) that is coupled to the header assembly 202. In particular, the pin terminals 232 that are received within the inner body portion 222 are configured to mate with the mating connector. FIG. 10 illustrates the latches 238 of the outer body portion 224 engaging the protrusions 240 of the inner body portion 222 to securely couple the inner and outer body portions 222, 224 to one another. In an exemplary embodiment, the projections 214 of the faceplate 208 are received within the gaps 244 between the latches 238 and the outer body portion 224 and reinforce the engagement between the latches 238 and the inner body portion 222 by substantially filling the gaps 244.

As illustrated in FIG. 10, the header shield 226 is mounted to the inner body portion 222. The header shield 226 completely surrounds a main body section 260 of the inner body portion 222. As such, the header shield circumferentially surrounds and shields the pin terminals 232 proximate to the interface of the pin terminals 232 and the mating connector. In an exemplary embodiment, a portion of the header shield 226 extends rearward from the main body section 260 and is exposed within the chamber 238. The portion of the header shield 226 that is exposed interfaces with a corresponding shield portion of the mating connector to electrically common the mating connector and the header assembly 202. Additionally, the mounting tabs 256 are flexed and biased against the faceplate 208 when the header assembly 202 is mounted to the housing 204.

During assembly, the forward section 248 is loaded through the opening 216 in the faceplate 208. The latches 250 engage the inner surface of the faceplate 208 and securely couple the header assembly 202 to the housing 204. Additionally, the header seal 234 is positioned between the outer body portion 224 and the rim 210 to seal the header assembly 202 from the external environment surrounding the power distribution module 200.

Referring to the above described embodiments, a power distribution module is thus provided that may be assembled in a cost effective and reliable manner. The header assembly may be quickly mounted to the housing, such as by the use of the latches. The snap coupling provided by the latches allows the header assembly to be mounted to the housing quickly and inexpensively, with a reduced part count, a reduced overall module size, and reduced assembly time. The header shield maintains good electrical contact with the faceplate once the header assembly is mounted to the housing, and the header shield maintains electrical connection with a mating connector to electrically common the mating connector and the housing. Additionally, a sealed environment is provided between the header assembly and the housing.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. A power distribution module comprising:

a housing having a component chamber configured to house an electrical component therein, at least a portion of the housing defines a shield interface; and a header assembly coupled to the housing, the header assembly includes a header body including an inner body portion and an outer body portion, the header body extends between a first end and an opposed second end, the header body being coupled to the housing at the first end, the header body defining a separable mating interface at the second end that is configured to receive a mating connector, the header assembly further including a header shield positioned between the inner and outer body portions, wherein the header shield engages the shield interface of the housing when the header assembly is coupled to the housing.

2. The power distribution module of claim 1, wherein a channel is formed between the inner and outer body portions, the header shield is received within the channel.

3. The power distribution module of claim 1, wherein the header body is fabricated from a dielectric material, the outer body portion completely surrounds an outer surface of the header shield to isolate the header shield from an environment surrounding the power distribution module.

4. The power distribution module of claim 1, wherein the header shield includes flexible mounting tabs extending therefrom, the mounting tabs engage the shield interface of the housing to create an electrical connection therebetween.

5. The power distribution module of claim 1, wherein the header shield includes mating tabs extending therefrom, the mating tabs are positioned within the header body for engagement with a mating connector to electrically common the header shield with the mating connector.

6. The power distribution module of claim 1, wherein the header assembly further includes a pin terminal received within the inner body portion, the pin terminal is configured to be electrically connected with the electrical component.

7. The power distribution module of claim 1, wherein the header assembly further includes a pin terminal received within the inner body portion, the pin terminal includes a mating interface configured to mate with a mating connector, wherein the header shield is positioned radially outward from the mating interface of the pin terminal to provide circumferential shielding of the pin terminal.

8. The power distribution module of claim 1, wherein the inner and outer body portions are integrally formed with one another.

9. The power distribution module of claim 1, further comprising an adhesive sealant applied between the header body and the housing.

10. The power distribution module of claim 1, wherein the housing is metallic, the header shield is electrically common with the metallic housing.

11. The power distribution module of claim 1, wherein the housing includes an opening through a wall defining the housing; and wherein at least a portion of the header assembly extends through the opening and is configured to electrically connect with the electrical component, at least one of the header body, the header shield and the housing includes a latch extending therefrom, wherein the header assembly is secured to the housing by the latch.

12. The power distribution module of claim 11, wherein the header assembly is snappably coupled to the housing by the latch.

13. The power distribution module of claim 11, wherein at least one of the header body and the header shield includes the latch, the latch is loaded through the opening and engages the wall of the housing to secure the header assembly to the housing.

14. The power distribution module of claim 11, wherein at least a portion of the housing defines a shield interface, and wherein the header shield includes a flexible tab extending therefrom that defines the latch, the tab engages the shield interface of the housing to create an electrical connection therebetween.

15. The power distribution module of claim 11, wherein the header body defines a trough at an end thereof and the housing includes a lip extending into the trough when the header assembly is secured to the housing, wherein an adhesive sealant is provided within the trough to bond to each of the trough and the lip.

16. The power distribution module of claim 11, wherein at least one of the housing and the header assembly includes a keying feature for keyed mating of the header assembly with the housing.

17. A header assembly for a power distribution module comprising:

a header body including an inner body portion and an outer body portion, a channel is formed between the inner and outer body portions and the inner body portion including a bore extending therethrough between a first end of the header body and a second end of the header body, the first end being configured for attachment to a housing of the power distribution module, the second end being configured to receive a mating connector therethrough;

a pin terminal received within the bore of the inner body portion and configured for engagement with the mating connector; and a header shield positioned in the channel and configured for engagement with the housing of the power distribution module and with the mating connector to electrically common the mating connector and the housing.

18. The power distribution module of claim 17, wherein the header shield includes a body having a hollow interior extending along a longitudinal axis, the header shield includes a first set of tabs extending from a first portion of the body and a second set of tabs extending from a second portion of the body, the tabs are oriented non-parallel to the longitudinal axis and the first set of tabs are configured to engage the housing of the power distribution module and the second set of tabs are configured to engage the mating connector.

19. The power distribution module of claim 17, wherein the header shield provides circumferential shielding of the bore.

20. The power distribution module of claim 17, wherein the inner and outer body portions are separately provided from, and snappably coupled to, one another.

* * * * *